US005775998A

United States Patent [19]

Ikematsu et al.

[11] Patent Number: 5,775,998

[45] Date of Patent: Jul. 7, 1998

[54] ANALYZER FOR DEVELOPING ATTRACTIONS IN A SHOOTING GAME SYSTEM

[75] Inventors: Shinichi Ikematsu; Hiroshi Kawakami; Satoshi Nakano; Tatsuya Kouno; Keisuke Hiromi; Masakazu Yoshimoto, all of Ohta-Ku, Japan

[73] Assignee: Sega Enterprises, Ltd., Tokyo, Japan

[21] Appl. No.: 681,513

[22] Filed: Jul. 23, 1996

Related U.S. Application Data

[62] Division of Ser. No. 418,029, Apr. 6, 1995, Pat. No. 5,613,913.

[30] Foreign Application Priority Data

Apr. 6, 1994 [JP] Japan ..... 6-090761

[51] Int. Cl.[6] ..... A63F 9/22

[52] U.S. Cl. ..... 463/52

[58] Field of Search ..... 463/52, 7; 273/371, 273/374, 460; 434/11, 16, 21, 22; 364/410

[56] References Cited

U.S. PATENT DOCUMENTS

| | | |
|---|---|---|
| 2,188,292 | 1/1940 | Hall et al. . |
| 2,404,653 | 7/1946 | Plebanek . |
| 4,533,144 | 8/1985 | Juarez et al. . |
| 4,545,583 | 10/1985 | Pearman et al. . |
| 4,695,058 | 9/1987 | Carter, III et al. . |
| 4,772,028 | 9/1988 | Rockhold et al. . |
| 4,934,937 | 6/1990 | Judd . |
| 5,232,227 | 8/1993 | Bateman . |
| 5,320,358 | 6/1994 | Jones . |
| 5,320,362 | 6/1994 | Bear et al. . |
| 5,351,966 | 10/1994 | Tohyama et al. . |
| 5,354,057 | 10/1994 | Pruitt et al. . |
| 5,382,026 | 1/1995 | Harvard et al. . |

FOREIGN PATENT DOCUMENTS

| | | |
|---|---|---|
| 40277 | 4/1991 | European Pat. Off. . |
| 534712 | 3/1993 | European Pat. Off. . |
| 509786 | 10/1930 | Germany . |
| 63-61898 | 3/1988 | Japan . |
| 3-123579 | 5/1991 | Japan . |
| 4-31118 | 7/1992 | Japan . |

OTHER PUBLICATIONS

International Defense Review, vol. 21, No. 11, Nov. 1988, Conintrin–Geneva CH, pp. 1465–1466, Roger Frost, "Public Enemy No. 1".

*Primary Examiner*—Jessica Harrison
*Assistant Examiner*—Michael O'Neill

[57] ABSTRACT

In a method for developing attractions in a shooting game system with which players can experience gun fights between the targets and players themselves, the present invention provides a method for developing attractions in a shooting game system with which the shooting game system can be easily installed in a short period anywhere and game quality can be always adjusted in the most suitable state. Namely, the method for developing attractions comprises the steps of producing various types of targets by combining fundamental mechanisms, each of which is used for a unit operation; incorporating unified control equipment and peripherals in the produced target to make them a target unit; embedding the above-described target unit in a target unit case so as to serve also as an indoor partition and posts; arranging the embedded target units in the designated rooms of the attraction hall.

6 Claims, 6 Drawing Sheets

ANALYZER FOR DEVELOPING ATTRACTIONS IN A SHOOTING GAME SYSTEM

This application is a divisional of application Ser. No. 08/418,029, filed on Apr. 6, 1995, now U.S. Pat. No. 5,613,913, the entire contents of which are hereby incorporated by reference.

BACKGROUND OF THE INVENTION

1. Field of the Invention

The present invention relates to a method for developing attractions in a shooting game with which players can experience gun fights between targets and the players themselves by arranging robot-type of targets in an attraction hall.

2. Description of the Related Art

Among games in which players play to shoot targets with model guns (rifles and the like) and which are arranged in playing spots, there are so-called competition-type of shooting games that robot-type of targets and players do gun fights with each other. Targets used in these competition type of shooting games only do very simple operations, although they are called robot-types. In addition, directions of guns are nearly fixed, and hence the targets shoot at fixed positions only. Therefore, according to arrangement methods of the targets, game quality remarkably changes. Accordingly, heretofore, by always arranging targets and the like with the same arrangement method in the same size of hall, game quality can be kept.

However, heretofore, in case the attraction such as the above-described competition type of shooting game is developed in a theme park (a park designed under a unified theme), stage settings, partitions, posts, and the like are incorporated as indoor facilities in a park layout design. Therefore, considerable expense is paid every installation in an attraction hall. In addition, the higher the game quality is, and the higher the degree of players' participation is, the more adjustment of the game quality becomes difficult. Therefore, even if veteran engineers on a system install targets and relating equipment in the system, much adjustment time is necessary. Owing to this, the period from the start of building to open of the park is long. Further, in case several attractions should be developed in the same time, many attraction-specific engineers should be trained. These problems are reasons why few attractions in theme parks have high degrees of players' participation and high game quality.

SUMMARY OF THE INVENTION

The present invention is intended as a solution to the aforesaid problems. The first object of the present invention is to provide a method for developing attractions in a shooting game system with which the shooting game system can be easily installed in a short period anywhere by unifying a target body, a partition, posts, and the like. Further, the second object of the present invention is to provide a method for developing attractions in a shooting game system with which game quality can be always set in the most suitable state.

As above described, the present invention relates to a method for developing attractions in a shooting game with which players can experience gun fights between targets and the players themselves by arranging robot-type of targets in an attraction hall. Therefore, the above-described first object of the present invention can be attained with a following process. That is, the process comprises the steps of: producing various types of targets by combining fundamental mechanisms each of which is used for a unit operation; incorporating unified control equipment and peripherals in the produced targets to make them a target unit; embedding the above-described target units in target unit cases respectively; arranging the above-described target units in the predetermined rooms of the above-described attraction hall to develop attractions.

Further, the second object is attained with a following process. That is, the process comprises the steps of: inputting arrangement information of the targets, which are arranged in a designated room of the above-described attraction hall, to a control system of the above-described shooting game system to save the information in memory means; displaying an arrangement state of the above-described targets on a monitor display on the basis of the arrangement information saved in the memory means so that the arrangement state in the above-described room can be confirmed on the above-described monitor display; and simulating a shooting game, which is the above-described gun fight between the targets and players on the basis of inputted operational information on players and the arrangement information of targets saved in the above-described memory means so that the game quality in the above-described arrangement can be examined.

DETAILED DESCRIPTION OF THE PREFERRED EMBODIMENTS

In the present invention, target units are constructed with fundamental mechanisms and control equipment, and the constructed target units are installed into target unit cases respectively to be installed in an attraction hall. In addition, the target unit cases are formed to serve also as partitions and posts in rooms. Therefore, various types of targets can be easily produced, and plenty of targets can be easily installed in a short period anywhere.

In addition, arrangement information of targets is inputted to a control system of a shooting game system, and is saved in memory means. Therefore, in case of executing the shooting game system, the operation of the targets can be controlled with the control system of the shooting game system, based on the arrangement information of the targets, and hence the game quality can be automatically adjusted to some extent. Furthermore, it is possible to display the arrangement state of targets on a monitor display, and further to simulate the shooting game on a screen. Therefore, if environment such as arrangement has a problem, it is easily confirmed, and hence game quality can be set in a most suitable state.

Hereinafter, embodiments of the present invention will be described with reference to drawings.

Figure 1:
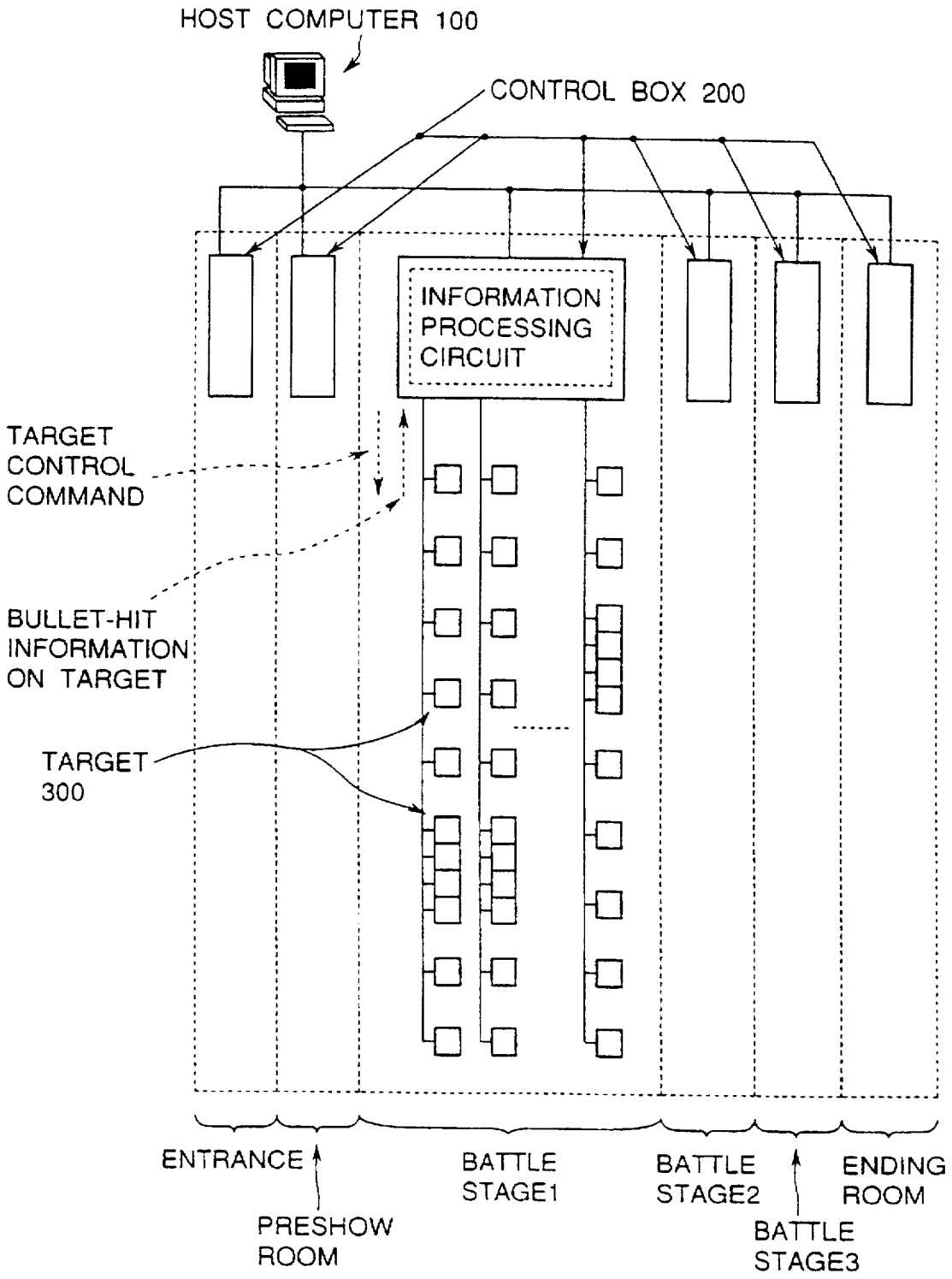
FIG. 1 is a schematic diagram showing an example of an entire constitution of a shooting game system according to the present invention.

Since FIG. 1 is a schematic diagram showing an example of an entire constitution of a shooting game system according to the present invention, first, the outline of the entire system will be described with reference to FIG. 1. A room for a shooting game that is provided in an amusement facility is partitioned into a plurality of rooms: an entrance where reception for the game, explanation of the game with a large monitor display for guidance, delivery of guns, and the like are done; a preshow room for preparing the game; battle stages 1 to 3 where gun fights with targets are played; and an ending room where players receive personal results or team results. Therefore, each player or each team composed of a plurality of players plays round the rooms.

A host computer 100 controls an entire system, and a control box 200 controls each room. The host computer 100 is connected to the control box 200 for each room via optical communication, executes the centralized control of the entire system such as flow of players, start/stop of the game, data acquisition, totaling, and reporting, and controls progress of the game. The control box 200 is a single frame from a hardware point of view, is commonly used for rooms, and controls a subsystem in each room by commands from the host computer 100.

Here, only the control in the battle stages according to the present invention will be explained. In the battle stages 1 to 3, the control box 200 transmits target control commands to the targets 300 via optical communication, and mainly controls many targets 300 (control of appearance, aiming, shooting, and the like). Each target 300 received the target control command follows the command: the target appears from the back of a post; it aims a player with a gun; or it attacks the player. Each target 300 has means for detecting bullet hitting and means for detecting players' positions, detected information on bullet-hit targets and on players' positions is transmitted to the control box 200 via optical communication. In this manner, in the battle stages 1 to 3, on the basis of predetermined information, the command information from the host computer 100, and the dynamic information sent from each target 300 as above-described, the control box 200 controls various operations of each target 300.

In a shooting game system like that in FIG. 1, many robot types of targets are installed in a play hall. In case these types of attractions are developed in a theme park, according to a conventional method for developing attractions, considerable expense is required and a period from the building start to park opening is long. By exemplifying a shooting game system in the above-described system configuration, a method for developing attractions in the shooting game system will be explained below.

Figure 2:
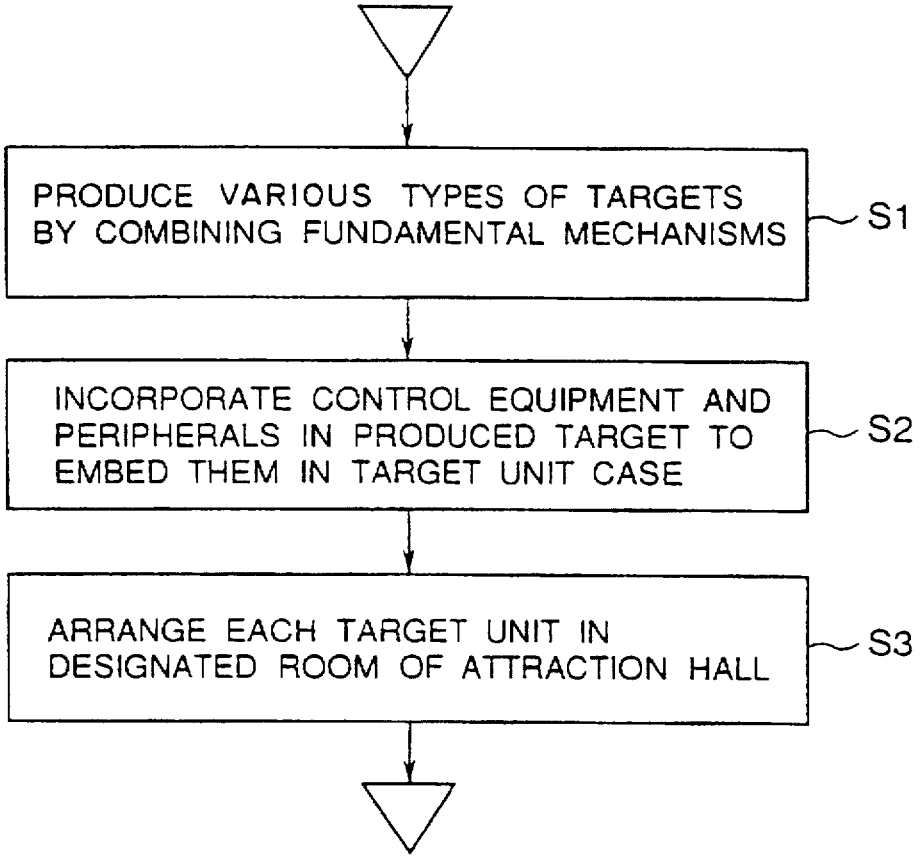
FIG. 2 is a flow chart for explaining a first embodiment of a method for developing attractions in a shooting game system according to the present invention.

FIG. 2 is a flow chart showing a procedure of a first embodiment of a method for developing attractions in a shooting game system according to the present invention, and shows a procedure until installation of targets in an attraction hall. According to the flow chart of FIG. 2, first of all, in a production process of targets, various operation types of targets are produced by combining fundamental mechanisms. Namely, the more robot-types of targets are, the more contents of a game system are well filled, while design and production per robot type need much labor and time. Therefore, by combining fundamental mechanisms that have unit operations such as vertical movement, horizontal movement, tilting, and rotation, and are produced beforehand, various operation types of targets are produced (Step S1).

In addition, control equipment and peripherals are incorporated in the produced targets to make them a target unit, which are embedded in a target unit case. The target unit case is formed beforehand to serve also as an indoor partition and posts. There are various types of targets such as a type that usually hides in the back of a post, appears for attacking, and hides again, a type that appears when a player approaches, and the like. Therefore, in order that the target unit case itself can be installed without foundation work such as partitioning, the target unit case is formed beforehand to serve also as a partition and posts.

Figure 3:
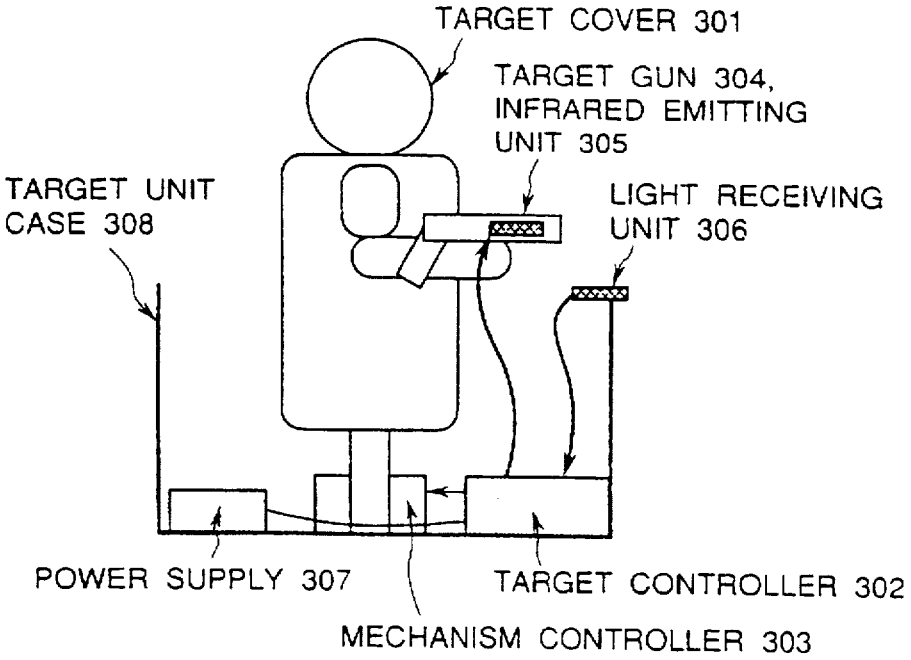
FIG. 3 is a structural diagram showing a first concrete example of a target assembled with a method according to the present invention.

FIG. 3 is a structural diagram showing a first concrete example of a target assembled with the above-described method. The target unit comprises: a target cover 301; a target controller 302 for controlling target operations and output of sound effects; a mechanism controller 303 for controlling operation mechanisms of the target by a command from the target controller 302; a target gun 304 that is a gun unit for the target; an infrared emitting unit 305 that emits infrared light corresponding to a bullet; a light receiving unit 306 for detecting infrared light shot (emitted) by a player; and a power supply 307. Further, these target units are incorporated in a target unit case 308.

As shown in FIG. 3, all of the control equipment and peripherals are unified. A target appearance is expressed by covering the target body composed of fundamental mechanisms, which are not shown, with the target cover 301. That is, by covering the target bodies with the target covers having various appearances, targets having various appearances can be expressed. In addition, a target unit case 308 for the type of target appearing from a post has a shape of a post or a box.

Figure 4:
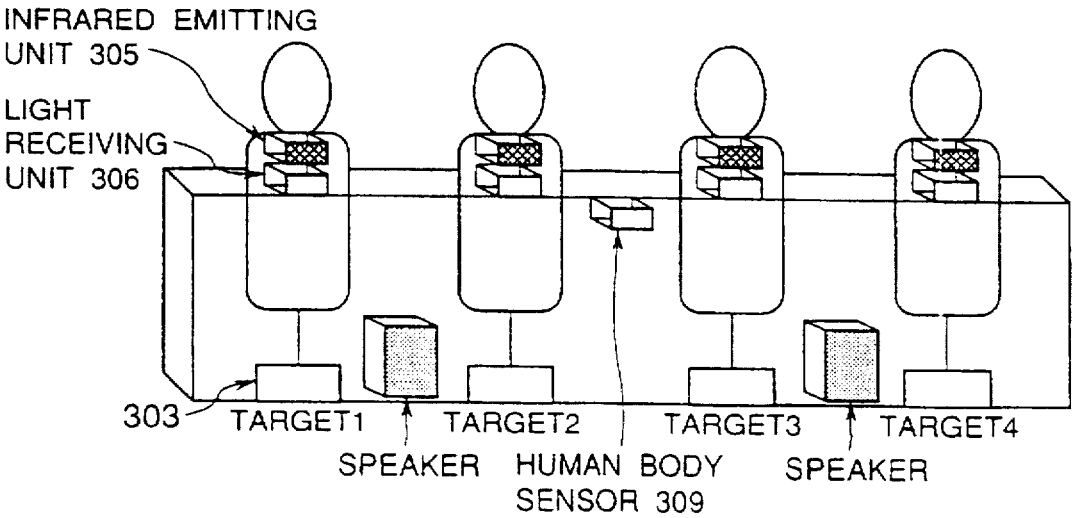
FIG. 4 is a structural diagram showing a second concrete example of a target assembled with a method according to the present invention.

FIG. 4 is a structural diagram showing a second concrete example of a target assembled with an above-described method. Namely, this is a configuration example of a target unit case that one target controller 302 controls four target units and two sound systems. In addition, in this example, since a human body sensor (pyro-electricity sensor and the like) 309 is set for detecting a player, each target attacks the player when the sensor detects the player in the area where the target can attack the player. In this manner, by combining fundamental units, various types of targets can be assembled. As shown in an example of FIG. 4, by installing a plurality of target units in a target unit case, fundamental units can be commonly used, and targets can be installed more easily in the attraction hall (Step S2).

Furthermore, by arranging target units installed in the target unit cases in the designated rooms, installation of targets is completed (Step S3). Further, although it is described that target unit cases are formed so as to serve also as partitions and posts, of course, it is possible to attach partitioning units and posts to fundamental target unit cases.

Figure 5:
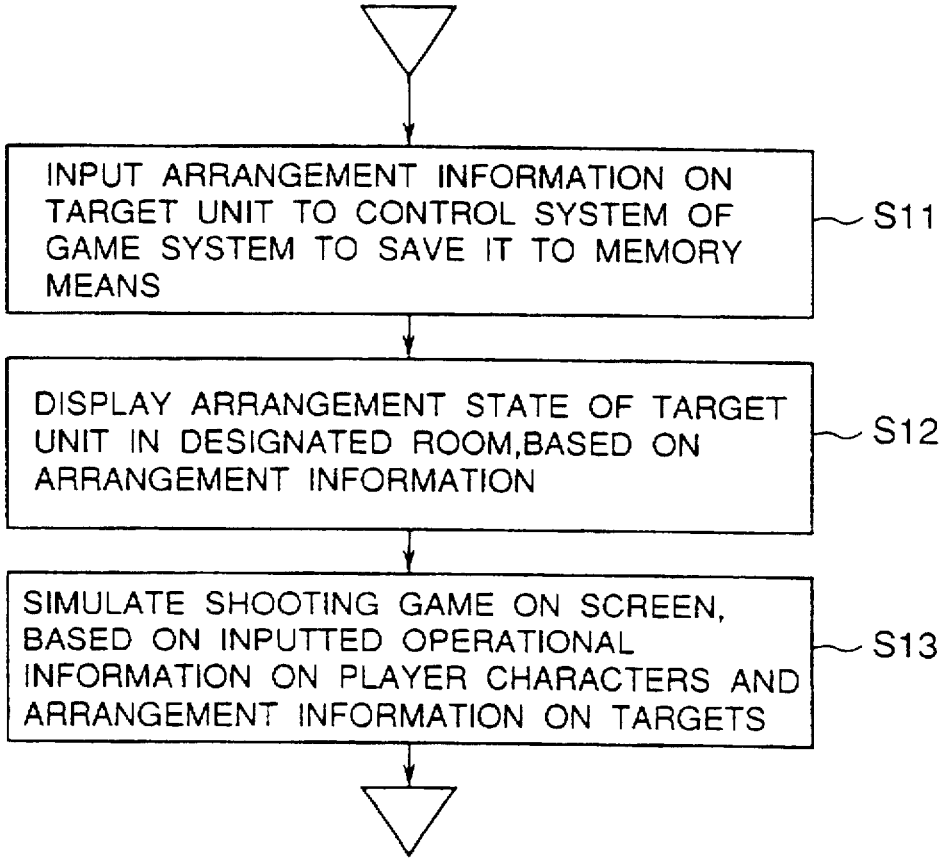
FIG. 5 is a flow chart for explaining a second embodiment of a method according to the present invention.
Figure 6A:
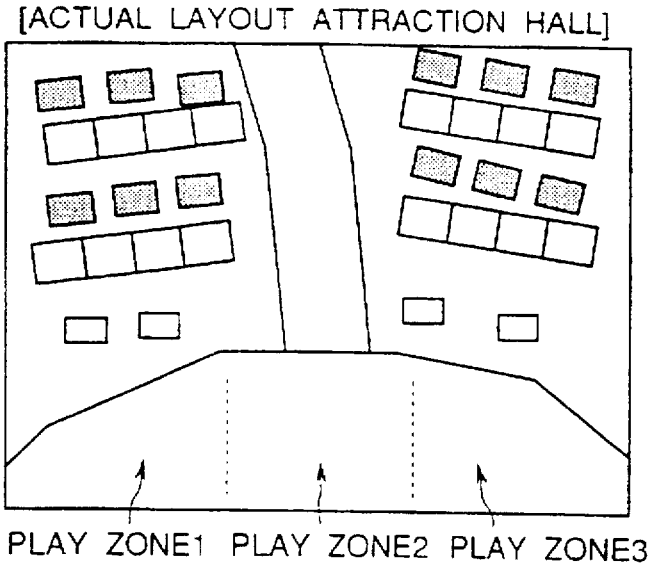
FIGS. 6A, 6B and 6C are drawings for explaining the second embodiment of a method according to the present invention.
Figure 6B:
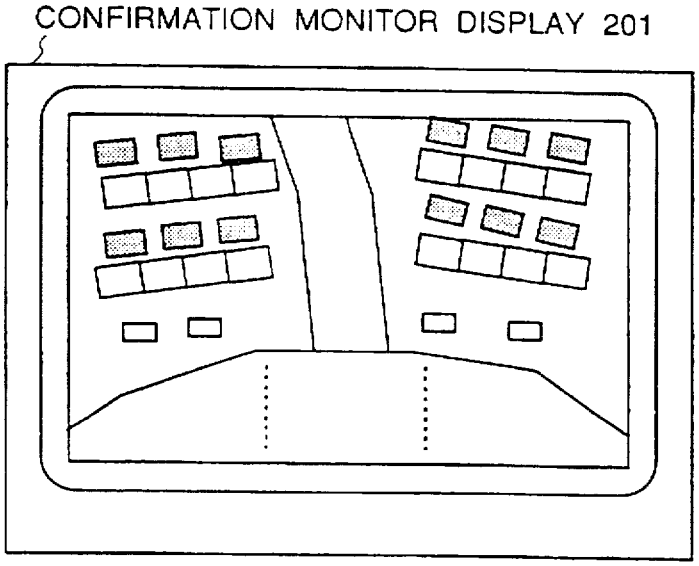
Figure 6C:
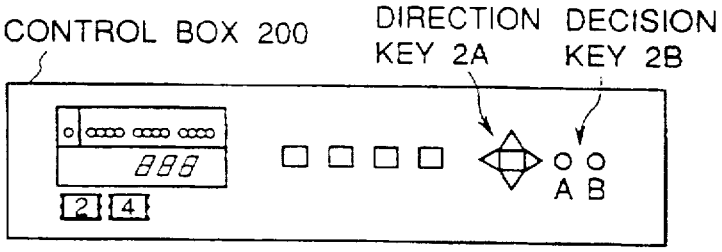

FIG. 5 is a flow chart showing a procedure of a second embodiment of a method for developing attractions in a shooting game system according to the present invention. FIG. 5 shows a procedure from inputting arrangement information of targets to the control system to simulating the game. With reference to FIGS. 6A, 6B and 6C, the second embodiment will be described according to the flow chart in FIG. 5. First of all, on the basis of the actual layout of an attraction hall (FIG. 6A), arrangement information of target units one by one with a select key 2*a* (direction key) and decision keys 2*b* (FIG. 6C). As the arrangement information, positions (three-dimensional positions) and angles of the targets in the attraction hall, the play zone where target guns aim players, and the like are inputted. The inputted arrangement information is saved in memory means of a control box 200 (Step S11).

The control box 200 follows a display instruction by an operator, and, on the basis of the inputted arrangement information, schematically displays the arrangement state of targets in the designated room on a confirmation monitor display as shown in FIG. 6B. Since the target units displayed on the display have schematic shapes of actual ones, actual arrangement can be accurately recognized only by looking at the confirmation monitor display (Step S12). Further, on the basis of the arrangement information of the targets, the shooting game that is gun fights between targets and players is simulated (Step S13). In addition, the Step S12 and Step S13 are not shown as time-series, and confirmation of the arrangement state and simulation of the game can be optionally executed by operator's command.

Figure 7:
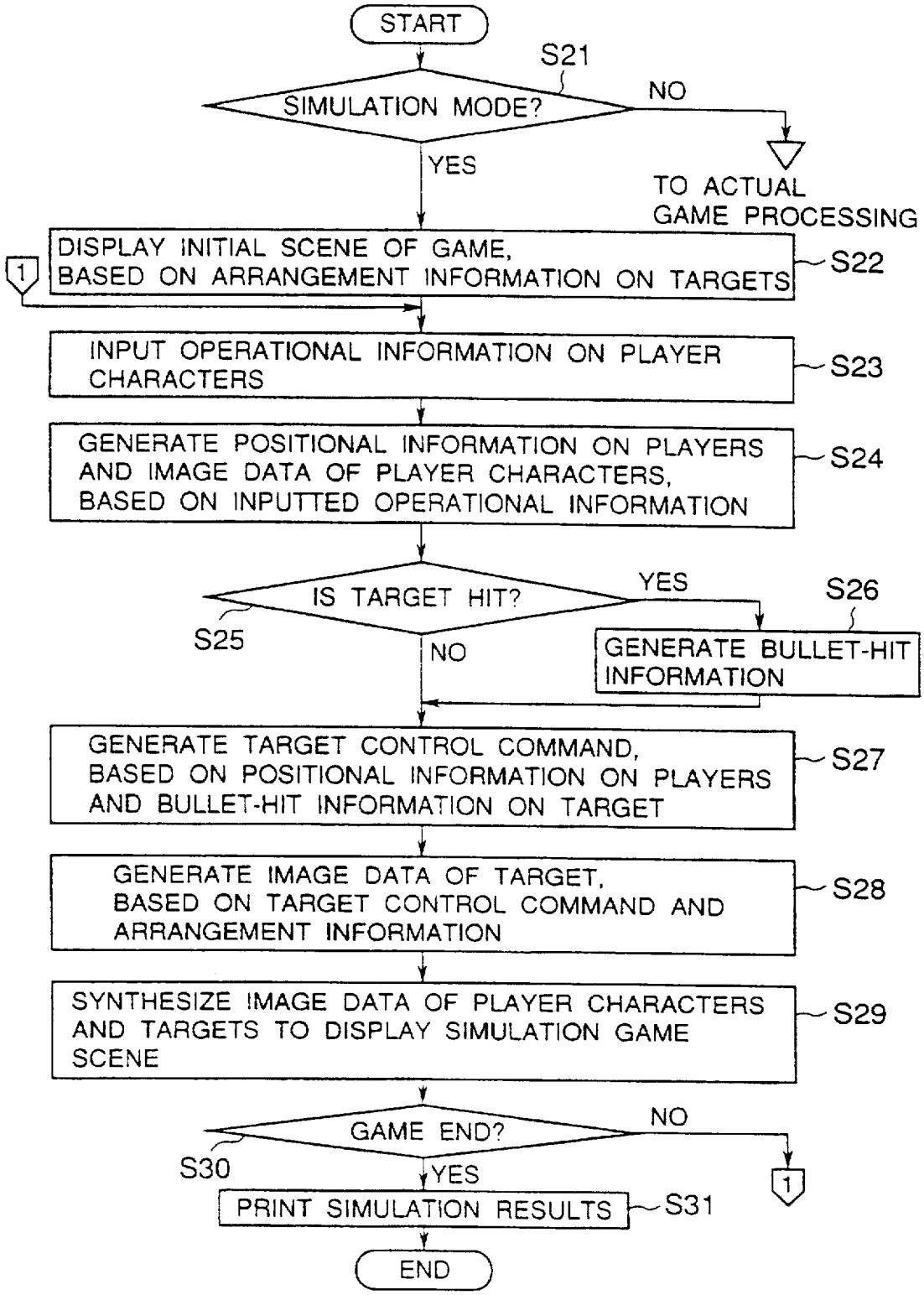
FIG. 7 is a flow chart for explaining an outline of simulation processing in FIG. 5.

Next, according to the flow chart in FIG. 7, the outline of simulation processing will be described. In an actual shooting game, the detected information on bullet-hit targets and on players' positions is transmitted to the control box 200 via optical communication, and, on the basis of arrangement information of targets and detected information on bullet-hit targets and on players' positions, various operations of each target 300 are controlled. However, in the simulation mode, the game is simulated on the basis of the same information.

In case the system mode is the simulation mode, the control box 200 displays a scene in the designated battle stage that is drawn on the basis of the arrangement information of the targets, for example, a scene shown in FIG. 6B. Further, player characters corresponding to actual players are displayed on a screen (Steps S21 and S22). An operator starts a shooting game on the screen with a start command, operates movement of the player characters and handling of guns with a direction key 2*a* and decision keys 2*b* in an operation panel, and executes a simulation game. Here, operational information on the player characters can be inputted from not only the operation panel but also common input apparatuses. Hence, on the basis of information inputted from each input apparatus, a shooting game composed of a plurality of players and targets can be simulated (Step S23).

On the basis of the inputted operational information on player characters, the control box 200 generates positional information on players and image data of player characters (Step S24), and, if a target is hit with a bullet, the control box 200 generates bullet-hit information on the target (Steps S25 and S26). In addition, on the basis of the positional information on players and the bullet-hit information on the target, the control box 200 generates a target control command (Step S27). Namely, processing at the Step S27 is the same as that in the actual game, and, as processing for simulation, the processing for displaying on a screen the result of simulating operations of players and targets is merely added to the control box 200.

Subsequently, the control box 200, on the basis of the target control command and arrangement information, generates image data of the target (Step S28), and displays a game scene by synthesizing image data of player characters and targets (Step S29). Furthermore, if the game is not completed, the process returns to the Step S23 and the control box 200 repeats above steps. If the game is completed, the control box 200 prints the simulation results and completes the processing (Steps S30 and S31). By executing the simulation as described above and looking at simulated scenes, the operator confirms the game quality. As simulation results, players' results that are outputted in the actual game are printed, and hence, by looking at these result also, the operator confirms the overall game quality.

In addition, in the above-described embodiment, as actual stage layout designed beforehand, a method for displaying an arrangement state and executing simulation is described. On the contrary, it is possible to display, first of all, a scene of a fundamental layout on a screen, to arrange targets on the screen to design the layout in a battle stage, to execute simulation of the game on the basis of the arrangement state, and to design the most suitable arrangement in the actual stage. In that case, for example, on the basis of the layout information on the battle stage and arrangement information on the targets, a plan for the designated stage and the like can be printed.

As described above, according to a method for developing attractions in a shooting game system, by unifying a target, a partition, posts, and the like, following effects can be obtained.

1) Since operation check per unit can be done in a production site, reliability increases.
2) The original design and inventory control of parts become remarkably easy.
3) Installation becomes simple, and an installation period and expense can be reduced.
4) Since a failed unit can be exchanged by unit, this is advantageous in the viewpoint of business.

In addition, by displaying an arrangement state of targets on the basis of arrangement information inputted to a system, and further executing simulation of a shooting game on a screen, following effects can be obtained.

1) A game whose game quality is remarkably changed by an arrangement method of targets cannot display the same game quality unless the game system is arranged with the same method and direction. However, by inputting the arrangement information, porting of the game quality becomes remarkably easy.
2) Since the game quality can be simulated on a monitor display on the basis of the inputted arrangement information, adjustment of the game quality becomes simple, and hence a specified engineer is not required.
3) This can easily correspond to minor layout change.

What is claimed is:

1. A shooting game quality analyzer comprising:

means for inputting arrangement information of targets in a shooting game to be analyzed;

a memory storing said arrangement information;

a monitor which displays an arrangement state of targets in accordance with said arrangement information;

means for inputting operational information on player characters;

means for simulating the shooting game to be analyzed including gun fights between targets and player characters in accordance with said arrangement information and said operational information; and means for analyzing, based on results of the simulating means, the game quality for targets located in said arrangement state.

2. The analyzer according to claim 1, wherein said means for inputting arrangement information is a control box.

3. The analyzer according to claim 1, further comprising means for confirming said arrangement information displayed on said monitor accurately reflects said arrangement states.

4. The analyzer according to claim 1, wherein said means for simulating comprises:

means for displaying said player characters on a screen; and means for controlling movement and gun handling of said player characters.

5. The analyzer according to claim 4, further comprising means for generating bullet hit information when one of the targets is hit with a bullet and providing said bullet hit information to said means for analyzing game quality.

6. The analyzer according to claim 1, wherein said arrangement information includes three-dimensional positions and angles of targets and play zones, where target guns aim at said player characters.

* * * * *